US006554585B1

(12) United States Patent
Maracchi

(10) Patent No.: US 6,554,585 B1
(45) Date of Patent: Apr. 29, 2003

(54) POWER GENERATING ASSEMBLY CAPABLE OF DUAL-FUNCTIONALITY

(76) Inventor: Giorgio Maracchi, Callie 21 #12-61 Edif, Ana P.H. Maracaibo (VE)

( * ) Notice: Subject to any disclaimer, the term of this patent is extended or adjusted under 35 U.S.C. 154(b) by 0 days.

(21) Appl. No.: 09/777,186

(22) Filed: Feb. 5, 2001

(51) Int. Cl.[7] ..... F04B 17/00

(52) U.S. Cl. ..... 417/364; 417/381; 417/521; 123/46 R

(58) Field of Search ..... 417/364, 380, 417/381, 521; 123/46 R

(56) References Cited

U.S. PATENT DOCUMENTS

| | | | | | |
|---|---|---|---|---|---|
| 1,657,641 | A | * | 1/1928 | Pescara | 123/46 R |
| 2,595,396 | A | * | 5/1952 | Lee | 60/39.76 |
| 3,500,804 | A | * | 3/1970 | Braun | 123/46 R |
| 4,292,814 | A | * | 10/1981 | Braun | 62/243 |
| 4,873,822 | A | * | 10/1989 | Benaroya | 60/39.75 |
| 5,775,273 | A | * | 7/1998 | Beale | 123/46 B |
| 6,035,637 | A | * | 3/2000 | Beale et al. | 417/364 |

* cited by examiner

*Primary Examiner*—Cheryl J. Tyler
*Assistant Examiner*—Michael K. Gray
(74) *Attorney, Agent, or Firm*—Malloy & Malloy, P.A.

(57) ABSTRACT

A power generating assembly structured to have dual functionality by combining an interactive operation of both an engine assembly and a compressor assembly in an at least partially segregated or isolated relation to one another within a common housing. The engine assembly may be connected to anyone of a plurality of different power take-offs in order that the power generated thereby is capable of doing work. Concurrently the compressor assembly is operative to pressurize a fluid flow passing there through and more specifically to increase the pressure of a refrigerant vapor which, after compression is transfer to a condenser or other utilitarian device for operation of a space conditioning or like facility. Interaction between the engine assembly and the compressor assembly is primarily attributable to the workings of a piston assembly comprising at least one but preferably a plurality of free moving pistons, wherein cyclical operation of the piston assembly defines a sequence of alternate compression and expansion phases of both the engine assembly and the compressor assembly.

27 Claims, 1 Drawing Sheet

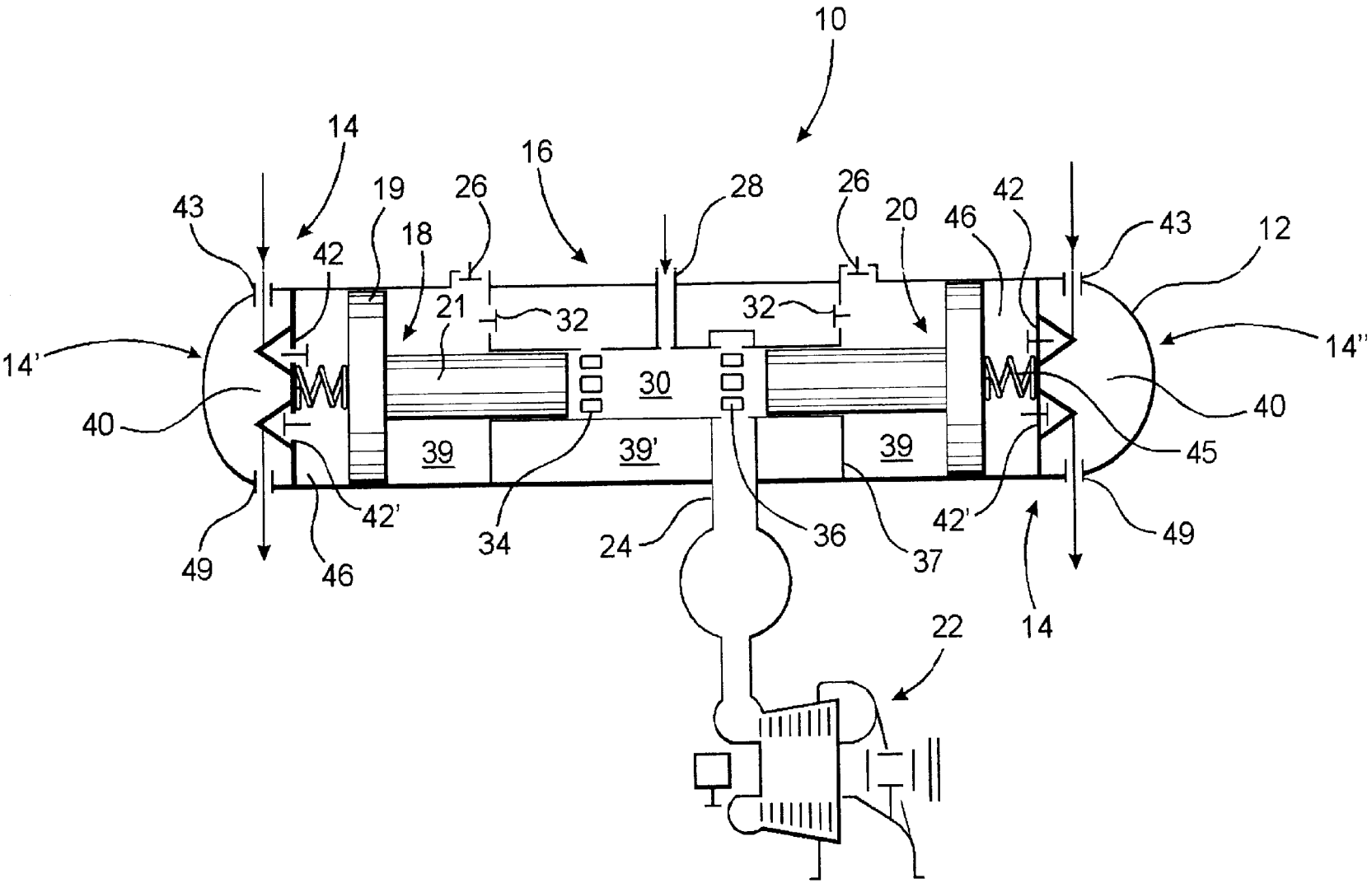
10
12
14''
40
45
43
49
14
42
46
42'
20
39
37
22
26
32
36
28
30
39'
24
16
34
21
18
19
14'

POWER GENERATING ASSEMBLY CAPABLE OF DUAL-FUNCTIONALITY

BACKGROUND OF THE INVENTION

1. Field of the Invention

The present invention is directed to a power generating assembly structured to be capable of dual functionality by the inclusion, in a common housing, of an engine assembly which may be connected in operative relation to a power take-off, and a compressor assembly interactive with the engine assembly and structured to further pressurize fluid flow therethrough concurrently to the operation of the engine assembly.

2. Description of the Related Art

Currently space conditioning assemblies which include both heating and cooling systems are commonly operated by means of an electric motor serving as the source of power. However, recent developments in the design and structure of both heating and cooling systems have led to an increased interest in engine driving systems. The primary difference being that the electric motor is replaced as a primary power source by a fuel powered engine. Such an alternative means of power has distinct advantages relating to variable speed operation capabilities, higher overall efficiency, efficient high temperature waste heat recovery, etc. Further, and by way of example only, the efficient waste heat recovery can be utilized for domestic water heating, process heating, steam generation, etc. thereby reducing the overall operating cost of the entire system. Accordingly, research in this area has led to the determination that engine driving conditioning assemblies, including both heating and cooling systems, can lead to the development of a system having improved cost and performance and an expanded range of products. Further, much of the research and development efforts currently being conducted are focused on developing small, engine driving systems that are suitable for single family dwellings as well as small commercial applications.

In general terms, engine driving cooling systems employ a conventional vapor compression cycle. The main components of such a compression system are the compressor, condenser, expansion valve and evaporator. In operation, the main steps of the conventional vapor condenser cycle include the compressor raising the pressure of low pressure refrigerant to a higher pressure level resulting in the higher pressure refrigerant having a higher saturation temperature. The condenser removes the heat from the high pressure vapor, allowing it to condensed to liquid at the higher temperature. As a result, heat is rejected to the cooling water. The expansion valve reduces the pressure of the liquid refrigerant and because the pressure is reduced, the saturation temperature is reduced as well. At this point some liquid may flash to vapor during the process. The evaporator supplies heat to the refrigerant from the chilled water. This heat boils the refrigerant at the lower temperature and pressure. By removing heat from the chilled water stream the chilledwater is cooled. Chillers are used to cool a chilled water stream which is then sent to the individual air coils. The air coils in turn cool the air being delivered to an intended space or zone. It is further acknowledged that smaller units, such as split systems and packaged roof top units, typically do not employ chilled water streams or cooling water streams, but rather use air coils to both directly remove heat from the condenser and cool and de-humidify the conditioned air stream with the evaporator. evaporator supplies heat to the refrigerant from the chilled water. This heat boils the refrigerant at the lower temperature and pressure. By removing heat from the chill water stream the chill water is cooled. Chillers are used to cool a chill water stream which is then sent to the individual air coils. The air coils in turn cool the air being delivered to an intended space or zone. It is further acknowledged that smaller units, such as split systems and packaged roof top units, typically do not employ chill water streams or cooling water streams, but rather use air coils to both directly remove heat from the condenser and cool and de-humidify the conditioned air stream with the evaporator.

In determining the most effective type of gas engine to be used as the primary power source in space conditioning systems, a variety of different internal combustion engines have been considered. In the conventional gasoline powered internal combustion engine, the combustion of fuel takes place in a confined space or cylinder and produces expanding gases that are used to provide the mechanical power. The most common internal combustion engine is the four stroke reciprocating engine used in the vast majority, if not almost all gasoline powered automobiles or vehicles. In such an application, mechanical power is supplied by a piston moving within the cylinder. Reciprocating movements of the piston within the cylinder serves to rotate or drive a crankshaft which is connected, by gearing to the drive wheels of the vehicle. An ignition spark is provided by an electrical system associated with the vehicle deriving power from a battery.

The diesel engine is also used to power vehicles, particularly trucks or other vehicles intended for heavy load conditions, but is also used as the basic power plant for a number of other commercial or industrial applications. The diesel engine is heavier and generally considered to be more powerful than the gasoline engine and burns a fuel less volatile than gasoline. The diesel engine differs from the gasoline engine in that the ignition of fuel is caused by the compression of air in its cylinder in the presence of a certain amount of heat, instead of a spark generated within a combustion cylinder. Typically the speed and power of the diesel engine are controlled by varying the amount of fuel injected into the cylinder. As set forth, diesel engines are widely used to power industrial and relatively small electric generators, continuously operating pumps as well as ships, trucks, locomotives and some automobiles.

One of many internal combustion engines capable of operating on either gasoline or diesel fuel is the free-piston engine, which was designed and developed in France in the early 1950's. Typically, the free-piston engine is a two cycle engine having a minimal amount of working parts and, as set forth above, is capable of operating on both diesel and gasoline fuel. When utilized as an engine/generator the free-piston engine comprises one moving part which may generally be defined by two spaced apart pistons interconnected to one another by a connecting rod having its opposite ends secured to each of the two pistons. The piston rod assembly is "free floating" or free moving. Further, the engine may be adjusted to assume any compression ratio needed to operate, using a variety of different fuels and combustion processes to facilitate low fuel consumption, when properly regulated by computer control. Recognized advantages of the free-piston engine over the four cycle gasoline engine, of the type generally described above, is the elimination of the crank shaft, thereby reducing weight and inertia factors in the operation of the engine. In addition, there is a greatly reduced number of moving parts, which significantly reduces the requirements for bearings and further at least partially eliminates frictional movements between moving parts. In addition, the utilization of a complicated valve train and timing functions associated with a four cycle engine is eliminated. Finally, there is no "wasted" strokes typically employed in the operation of a conventional four cycle engine.

While it is apparent that extended research and development has been conducted in the areas briefly discussed above, there is a still a need for a more versatile power generating assembly which is designed and structured to incorporate many of the advantage of the above noted devices. Such an improved power generating assembly should be capable of dual functionality in terms of generating power to any one of a plurality of different power take-off devices as well as provide a compressor function in the pressurization of fluid or more specifically refrigerant vapor, which may used in a variety of different heating or cooling systems.

SUMMARY OF THE INVENTION

The present invention is directed to a power generating assembly structured to concurrently perform dual functions. More specifically, the power generating assembly of the present invention incorporates both an engine assembly and a compressor assembly in a common housing. The engine assembly and the compressor assembly are partially segregated but yet interactive with one another during the operation of the power generating assembly. The interactive relation between the compressor assembly and the engine assembly is accomplished through the cooperative workings of a piston assembly comprising at least one but preferably two free moving pistons which are an operative, working component of both the engine assembly and compressor assembly. In addition, the design and structure of the piston assembly is such as to substantially isolate the respective paths of working-fluid flow through of the compressor assembly and engine assembly. Accordingly, this interactive yet at least partially segregated working relation between the compressor assembly and engine assembly allows each to perform working functions which are not necessarily related to one another in terms of work output.

Therefore, the engine assembly may be operatively or drivingly connected to a power take-off, such as but not limited, to an expansion gas turbine. The power take-off, regardless of its structural embodiment, can be used to perform various different categories of work, which may or may not be related to the work or operative functioning of the compressor assembly. The compressor assembly may be incorporated into a space conditioning system or cooling system and more specifically serves to increase the pressure of a refrigerant vapor for subsequent transfer, after pressurization, to a condenser or other component associated with the space conditioning assembly.

In at least one preferred embodiment, to be described in greater detail hereinafter, the power generating assembly is designed and structured to operate on natural gas fuel. Naturally the power generating assembly of the present invention is capable, with little or no modification, of operating using a variety of combustible fuels or fuel mixtures. Accordingly, the fuel enters the housing, which is structured to enclose and movably support both the engine assembly and the compressor assembly, in direct reactive relation to the aforementioned piston assembly. The housing includes at least one cylinder which is structured to not only receive the fuel entering the housing but facilitate compression thereof by the aforementioned one or more pistons, as they concurrently travel into a compression phase associated with the engine assembly. The ignition of the fuel will cause forced travel of the pistons into an expansion phase of the engine assembly. Importantly, the structure and disposition of the piston assembly is such as to define a compression phase of the compressor assembly concurrently to an expansion phase of the engine assembly. Therefore, during continuous operation of the power generating assembly of the present invention, cyclical movement of the piston assembly, defines a sequence of alternate compression and expansion phases of both the engine assembly and the compressor assembly. The alternate compression and expansion phases of the engine assembly and compressor assembly are, as generally described above, more specifically intended to concurrently define a compression phase of the engine assembly while at the same time defining an expansion phase of the compressor assembly. The normal cyclical movement of the piston assembly will then alternatively and concurrently define an expansion phase of the engine assembly, while at the same time defining a compression phase of the compressor assembly.

Forced cyclical movement of the piston assembly in the manner described above is accomplished by the expansion or ignition of the fuel within the receiving chamber. In addition, biasing means in the form of a variety of different spring structures or other force generating mechanisms may be directly connected to or alternatively otherwise act on each of the one or more pistons of the piston assembly in a manner which forces the piston assembly between the aforementioned alternate compression and expansion phases of the engine assembly and the compressor assembly. Accordingly, the biasing means may be defined, in at least one embodiment of the present invention, by one or more spring mechanisms or structures disposed and structured to exert a biasing force on each of the one or more pistons as set forth above. Alternatively and also by way of example only, the biasing means can comprise a significantly different or structurally distinguishable mechanism such as, but not limited to a fluid cushion chamber.

Regardless of the specific structural embodiments incorporated within the power generating assembly of the present invention, it is structured to operate on a dual functionality basis thereby increasing its efficiency and significantly reducing its cost of operation while enhancing its overall versatility in terms of being adaptable for a variety of different practical applications.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

The single FIGURE of the drawings is a schematic representation shown in longitudinal section representative of the orientation and positioning of the various components of the power generating assembly of the present invention.

Like reference numerals refer to like parts throughout the several views of the drawings.

DETAILED DESCRIPTION OF THE PREFERRED EMBODIMENT

As shown in the accompanying FIGURE, the present invention comprises a power generating assembly generally indicated as 10 and including a housing 12. The housing 12 has an at least partially hollow interior separated into a plurality of chambers which accommodate the operation and functioning of a compressor assembly, generally indicated as 14 and an engine assembly, generally indicated as 16. In addition, the housing 12 includes a valve assembly comprising a plurality of valves, each of which will be described in detail with regard to their specific operation and association with either the workings of the compressor assembly 14 or the engine assembly 16.

The power generating assembly 10 of the present invention further comprises a piston assembly preferably, but not exclusively including two pistons, 18 and 20. Each of the pistons are "free-moving" in that the individual pistons 18 and 20 are not connected to one another or to any direct drive mechanism such as, but not limited to a crankshaft or like linkage typically present in four cycle internal combustion engines. The structure and moving disposition of each of the pistons 18 and 20 within the housing 12 defines the engine assembly 16 as a two cycle engine by virtue of the pistons 18 and 20 each moving in an opposite but concurrently reciprocating path of travel. Cyclical movement of the piston assembly defines a continuous operation of both the compressor assembly 14 and the engine assembly 16, wherein the aforementioned cyclical movement of the piston assembly defines a sequence of alternate compression and expansion phases of both the compressor assembly 14 and the engine assembly 16, as will be explained in greater detail hereinafter. The interactive relation between the compressor assembly 14 and the engine assembly 16 is therefore defined in part by the cyclical operation of the piston assembly and its sequence of defining alternate compression and expansion phases thereof. However, the compressor assembly 14 and the engine assembly 16 are also to be considered at least partially segregated from one another in that although they are interactive, respective paths of fluid flow there through are isolated from one another.

As also shown in the accompanying FIGURE, the engine assembly 16 may be connected to any one of a variety of different power take-offs. In the represented preferred embodiment, the power take-off is generally indicated as 22 and comprises an expansion gas turbine. An appropriate conduit 24 serves to interconnect the power take-off or gas turbine 22 with the engine 16 in a manner which will be described in greater detail hereinafter. However, the power take-off 22, preferably comprising an expansion gas turbine, is operatively associated to do a variety of different work applications by virtue of it receiving expanded gas through conduit 24. As such, the power generating assembly 10 and more specifically the engine assembly 16 may generally define a "gasifier".

The power generating assembly 10 includes one or more inlets 26 for the admission of fuel and/or an air/fuel mixture, each inlet 26 is cooperatively disposed and associated with the reciprocal path of the individual pistons 18 and 20. An inlet 28 is disposed in direct communication with the chamber 30 and serves to direct fuel or a combustible air/fuel mixture therein. Discharge valves 32 are cooperatively disposed and structured with corresponding ones of the inlets or inlet valves 26. Also the interior chamber 30 includes one or more scavenger ports 34 and one or more exhaust or delivery ports 36. The scavenger ports 34 and the exhaust ports 36 are disposed to be periodically opened and closed, at the proper time, by the aforementioned cyclical, reciprocating travel of the respective pistons 18 and 20. One feature of the reciprocating travel and relative disposition of the pistons 18 and 20 is that the speed is higher near inner dead points and lower near outer dead points, leaving less time for combustion and more for scavenging. As represented in the accompanying FIGURE, each of the pistons 18 and 20 is disposed substantially at the end of the expansion phase of the engine assembly 16 and correspondingly, at the end of the compression phase of the compressor assembly 14. As such, scavenger ports 34 and exhaust ports 36 are open. Similarly, in the position shown, the inlet ports 26 are open so as to receive fluid from the exterior of the housing 12 into the chambers 39. Concurrently discharge valves 32 are closed.

The interior chamber 30 of engine assembly 16 is formed by a cylinder 31 which connects to central chamber 39' through ports 34. Lateral walls 35, 37 in conjunction with housing 12 form the central chamber 39'. Valves 32 in the lateral walls fluidly connect inlet chamber 39 with the central chamber 39'. Thus, fluid enters the engine assembly through inlet valve 26 and enters inlet chamber 39. From there the fluid travels through valve 32 into central chamber 39 and enters through ports 34. Upon entering ports 34 the fluid is compressed in the interior chamber 30 by piston rod 21, undergoes combustion and exits through exhaust ports 36 to conduit 24. The piston 18 includes piston head 19 and piston rod 21 with the piston head 21 compressing a fluid which enters inlet 43 of the compressor assembly 14. After entering inlet 43 the fluid travels through valves 42, 42' before being expelled from exit 49. The inlet chamber 39 of the engine assembly 16 is formed by the piston head 19 and lateral wall 35. A spring 45 biases the piston assembly such that each piston 18 is normally biased in a position corresponding to a compression phase in the engine assembly and an expansion phase in the compressor assembly.

In the reverse direction of travel each of the pistons 18 and 20 will be passing through a compression phase of the engine assembly 16 and an expansion phase of the compressor assembly 14. During such expansion phase of the compressor assembly 14, fluid flow will be drawn into the receiving chambers 40 of each of the oppositely disposed compressor sections 14' and 14". Concurrently each of the valves 42 will be opened to allow the fluid to pass through the inlet 43 in chambers 40 and into the compressor chamber 46 of each of the compressor sections 14' and 14". At the same time, valves 42' will be closed to facilitate the path of fluid flow through the inlet 43 of each compressor section 14' and 14" so as to be in a position within the receiving chambers 46 to react with and more specifically be compressed upon the reverse travel of each of the corresponding pistons 18 and 20.

Upon the occurrence of the reverse path of travel, of each of pistons 18 and 20 will then pass back into the compression phase associated with the compressor assembly 14 and the expansion phase associated with the engine assembly 16. At this time valves 42 will close and valves 42' will open thereby allowing the compressed fluid passing through the compressor sections 14' and 14" to be pressurized to a sufficient level and subsequently be transferred through outlet 49 to a condenser or other component associated with a space conditioning assembly, cooler, etc. Assuming that the compressor assembly 14 is to be a working part of such a conditioning assembly or cooler, the fluid flow passing into and out of each of the compressor sections 14' and 14" will be a refrigerant vapor which will enter through the inlet 43 and valve 42 at a first pressure. Upon the pistons 18 and 20 passing into the compression phase associated with the compressor assembly 14, the refrigerant vapor will be raised to a second, increased pressure and transferred to the condenser through the aforementioned outlet valves 42' and outwardly from the housing 12 through outlet 49. Compression of the refrigerant vapor is further facilitated through the inter-action and variable volume of the receiving chamber 46, as the pistons 18 and 20 pass between the alternate compression and expansion phases of each of the pressure assembly 14 and engine assembly 16. It should therefore be apparent that as each of the pistons 18 and 20 are in a compression phase of one of the compressor assembly 14 or engine assembly 16 they simultaneously define an opposite phase or expansion phase of the other of the compressor assembly 14 and engine assembly 16.

Further, the operation of the engine assembly 16 is such that the pistons 18 and 20 traveling inwardly, towards one another, define the compression phase of the engine assembly 16. When so compressed, the fuel in the chamber 30 is ignited. This causes the pistons 18 and 20 to travel outwardly from one another thereby defining the expansion phase of the engine assembly and simultaneously defining the compression phase of the compressor assembly 14. Such interaction of the movement of the pistons 18 and 20 will cause the ignited fuel within the chamber 30 to be exhausted through the exhaust port 36 into the conduit 24 for interaction with the power take-off or gas turbine 22. Subsequently, the expansion phase of the engine assembly 16 also comprises the air or other mixture flowing into the scavenger ports 34 from the respective inlet ports 26 and discharge ports 32 as described above. An air fuel mixture will then be "trapped" and compressed within the chamber 30 upon the fuel being passed through the inlet 28 as described above.

Another preferred embodiment of the present invention is primarily directed to the operational features of the power generating assembly 10 rather than being directed to any significant structural modifications of the housing 12 or other operative components contained therein. More specifically, the power generating assembly 10 in this additional preferred embodiment includes the use of any one of a variety of combustible fuels such as, but not limited to, a liquid petroleum gas. Further, the inlet or access area 28 in this additional preferred embodiment defines an ignition chamber and is directly associated with some type of ignition device or mechanism such as a timing array and an associated spark plug, glow plug, etc. In operation as the piston 18 and 20 extend outwardly, substantially in the position shown in the accompanying FIGURE, the air fuel mixture is drawn into the inlets 26 and is contained within chambers 39 until the individual pistons 18 and 20 begin to move into a compression phase associated with the engine assembly 16 and out of the compression phase associated with the compressor assembly 14. More specifically, the inwardly directed travel of the pistons 18 and 20 will force the air fuel mixture, now contained within the chamber 39, to pass into the central chamber 39' through the inlets or inlet valve 32. Further, the inlets 26 are structured to automatically close as the pistons 18 and 20 move inwardly towards one another and further as the inlet valves 32 open. Fluid communication is established between the interior of the central chamber 39' and the chamber 30 such that fluid communication can be established through, what was formally described as the scavenger port 34 or alternately through some type of additional communication port, located where appropriate. Further, the additional inlet or communication port may be associated with some type of one way or two way valve system to further facilitate the efficient operation of this second preferred embodiment of the present invention. Once the air fuel mixture is forced into the chamber 30 an associated timing mechanism will serve to "fire" the ignition device, which is mounted within or directly associated with what in this embodiment is referred to as the ignition chamber 28. The ignition and combustion of the air fuel mixture within the chamber 30 again forces the pistons 18 and 20 outwardly towards and eventually into the position as shown in the accompanying Figure.

From the above description, it should be apparent that the piston assembly comprising the one or more pistons 18 and 20 defines interaction between the compressor assembly 14 and the engine assembly 16, during operation of either of the above operated preferred embodiments. The cyclical movement of the piston assembly defines a sequence of alternate compression and expansion phases of the engine assembly and the compressor assembly, as described. However, at least partial segregation exist between the interacting compressor assembly 14 and engine assembly 16 due to the fact that the respective flow of fluids through both the compressor assembly 14 and engine assembly 16 do not interact but maintain and perform the intended workings of the respective compressor assembly 14 and engine assembly 16.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A power generating assembly capable of dual functionality, said assembly comprising:

a housing;

an engine assembly arranged in said housing, said engine assembly having a combustion chamber;

a compressor assembly arranged in said housing; and a piston assembly including a piston head and a piston rod movably mounted within said housing such that said engine assembly and said compressor assembly are in interactive relation to one another, said piston head is arranged in said housing such that said engine assembly is positioned on one side of the piston head and said compressor assembly is positioned on an opposite side of the piston head, said piston head contributing to compression of a fluid in said compressor assembly and said piston rod contributing to combustion of a second fluid in said engine assembly.

2. A power generating assembly as recited in claim 1 further comprising a power take-off operatively connected to said engine assembly and structured to operate an auxiliary facility.

3. A power generating assembly as recited in claim 1 wherein said compressor assembly is structured to receive a gas at a first pressure and deliver the gas from said compressor assembly at a second increased pressure.

4. A power generating assembly as recited in claim 1 further comprising a power take-off connected to said engine assembly and structured to operate an auxiliary facility; said compressor assembly structured to receive a gas at a first pressure and deliver the gas therefrom at a second increased pressure.

5. A power generating assembly as recited in claim 1 wherein said piston assembly is free moving within said housing.

6. A power generating assembly as recited in claim 1 wherein said piston assembly comprises at least one piston, free moving within said housing and determinative of said respective fluid flows through said engine assembly and said compressor assembly.

7. A power generating assembly as recited in claim 1 wherein said piston assembly comprises at least two pistons each free moving within said housing and collectively determinative of respective fluid flows through said engine assembly and said compressor assembly.

8. A power generating assembly as recited in claim 1 wherein cyclical movement of said piston assembly defines a sequence of alternate compression and expansion phases of said engine assembly and said compressor assembly.

9. A power generating assembly as recited in claim 8 wherein said piston assembly is movably disposed within said housing so as to concurrently define a compression phase of said engine assembly and an expansion phase of said compressor assembly.

10. A power generating assembly as recited in claim 9 wherein said piston assembly is movably disposed within said housing to concurrently define an expansion phase of said engine assembly and a compression phase of said compressor assembly.

11. A power generating assembly as recited in claim 1 wherein said piston assembly comprises at least two pistons each free moving within said housing in physically unconnected relation to one another.

12. A power generating assembly as recited in claim 11 wherein cyclical movement of said piston assembly defines a sequence of alternate compression and expansion phases of said engine assembly and said compressor assembly.

13. A power generating assembly as recited in claim 12 wherein said pistons are collectively movable within said housing to concurrently define a compression phase of said engine assembly and an expansion phase of said compressor assembly.

14. A power generating assembly as recited in claim 13 wherein said pistons are concurrently movable within said housing to collectively define an expansion phase of said engine assembly and a compression phase of said compressor assembly.

15. A power generating assembly as recited in claim 11 further comprising a biasing means disposed within said housing in biasing relation to each of said pistons and for normally positioning each of said pistons into a compression phase of said engine assembly and an expansion phase of said compressor assembly.

16. A power generating assembly capable of dual functionality, said assembly comprising:

a housing;

an engine assembly arranged in said housing, said engine assembly having a first valve, which introduces fluid into an inlet chamber and a second valve through which the fluid exits the inlet chamber and enters a central chamber such that a first fluid flow path is formed by said first and second valves, said inlet chamber, and said central chamber of said engine assembly;

a compressor assembly arranged in said housing, said compressor assembly having an inlet and an outlet and having a valve assembly such that a second fluid flow path is formed by said inlet, said valve assembly and said outlet of said compressor assembly;

a piston assembly movably mounted within said housing such that said engine assembly and said compressor assembly are in interactive relation to one another, said piston assembly including a piston head which is arranged in said housing such that said engine assembly is positioned on one side of the piston head and said compressor assembly is positioned on an opposite side of the piston head; and wherein said first fluid flow path and said second fluid flow path are completely separate and independent from one another, and said piston assembly is determinative of respective fluid flows in said first and second fluid flow paths.

17. A power generating assembly as recited in claim 16 wherein said compressor assembly comprises a plurality of compression chambers each including an inlet and an outlet cooperatively disposed relative to said valve assembly to regulate fluid flow into and out of said compression chambers.

18. A power generating assembly as recited in claim 17 wherein each of said compression chambers of said compressor assembly is structured to receive a refrigerant vapor at a first pressure and deliver the refrigerant vapor therefrom at a second increased pressure.

19. A power generating assembly as recited in claim 17 wherein said piston assembly comprises at least two pistons each free moving within said housing and each determinative of both pressurization within and flow of fluid through different ones of said compression chambers.

20. A power generating assembly as recited in claim 19 further comprising a biasing means disposed in biasing relation to each of said pistons and structured to normally and concurrently position said pistons in predetermined relation to said engine assembly and said compressor assembly.

21. A power generating assembly as recited in claim 19 wherein cyclical movement of said two pistons defines a sequence of alternate compression and expansion phases of said engine assembly and said compression assembly.

22. A power generating assembly as recited in claim 21 wherein said pistons are movable within said housing to collectively define a compression phase within said engine assembly and an expansion phase within each of said compression chambers.

23. A power generating assembly as recited in claim 22 wherein said pistons are movable within said housing to concurrently define an expansion phase within said engine and a compression phase within each of said compression chambers.

24. A power generating assembly as recited in claim 23 further comprising biasing means disposed within said housing to normally bias each of said pistons into a compression phase of said engine assembly and an expansion phase of each of said compression chambers.

25. A power generating assembly as recited in claim 24 wherein said plurality of compression chambers and said pistons are equal in number and correspondingly positioned to said pistons.

26. A power generating assembly as recited in claim 16 further comprising a power take-off connected to said engine assembly and structured to operate an auxiliary facility.

27. A power generating assembly capable of concurrent dual functionality, said assembly comprising:

a housing;

an engine assembly arranged in said housing, said engine assembly having a first valve, which introduces fluid into an inlet chamber and a second valve through which the fluid exits the inlet chamber and enters a central chamber such that a first fluid flow path is formed by said first and second valves, said inlet chamber, and said central chamber of said engine assembly;

a compressor assembly arranged in said housing, said compressor assembly having an inlet and an outlet and having a valve assembly such that a second fluid flow path is formed by said inlet, said valve assembly and said outlet of said compressor assembly;

a piston assembly including a piston head and a piston rod movably mounted within said housing such that said engine assembly and said compressor assembly are in interactive relation to one another, said piston head is arranged in said housing such that said engine assembly is positioned on one side of the piston head and said compressor assembly is positioned on an opposite side of the piston head, said piston head contributing to compression of a fluid in said compressor assembly and said piston rod contributing to combustion of a second fluid in said engine assembly; and wherein said first fluid flow path and said second fluid flow path are completely separate and independent from one another, and said piston assembly is determinative of respective fluid flows in said first and second fluid flow paths.

* * * * *